United States Patent [19]

Braun

[11] Patent Number: 4,931,600

[45] Date of Patent: Jun. 5, 1990

[54] CYLINDER KEY SWITCH

[75] Inventor: Peter B. Braun, Bornheim, Fed. Rep. of Germany

[73] Assignee: DOM-Sicherheitstechnik GmbH & Co. KG, Bruhl, Fed. Rep. of Germany

[21] Appl. No.: 215,710

[22] Filed: Jul. 6, 1988

[30] Foreign Application Priority Data

Aug. 3, 1987 [DE] Fed. Rep. of Germany ... 8710596[U]

[51] Int. Cl.[5] ..... H01H 27/06

[52] U.S. Cl. ..... 200/43.08; 200/43.11; 200/303

[58] Field of Search ..... 200/43.08, 43.07, 43.11, 200/43.13, 303

[56] References Cited

U.S. PATENT DOCUMENTS 4,398,067 8/1983 Rubinstein et al. ..... 200/43.11
4,622,444 11/1986 Kandatsu et al. ..... 200/303
4,647,735 3/1987 Sicher ..... 200/43.08
4,778,954 10/1988 Haüser ..... 200/43.08

FOREIGN PATENT DOCUMENTS 93327 4/1983 European Pat. Off. ..... 200/303
2440366 3/1976 Fed. Rep. of Germany ..... 200/303

*Primary Examiner*—Renee S. Luebke
*Attorney, Agent, or Firm*—Barry E. Deutsch; J. Bruce Hoofnagle

[57] ABSTRACT

A cylinder-operable key switch 5 comprises a cylinder housing 1 and a cylinder core 7 mounted rotatably therein, which acts upon an electrical switching device 3. The switching device 3 is located at one side of and adjacent to the cylinder core 7 which operates the switching device 3 by rotation of a control member 18.

The key switch is particularly suitable for fitting to electronic equipment, where it provides a high insulation against flash-over voltage.

15 Claims, 3 Drawing Sheets

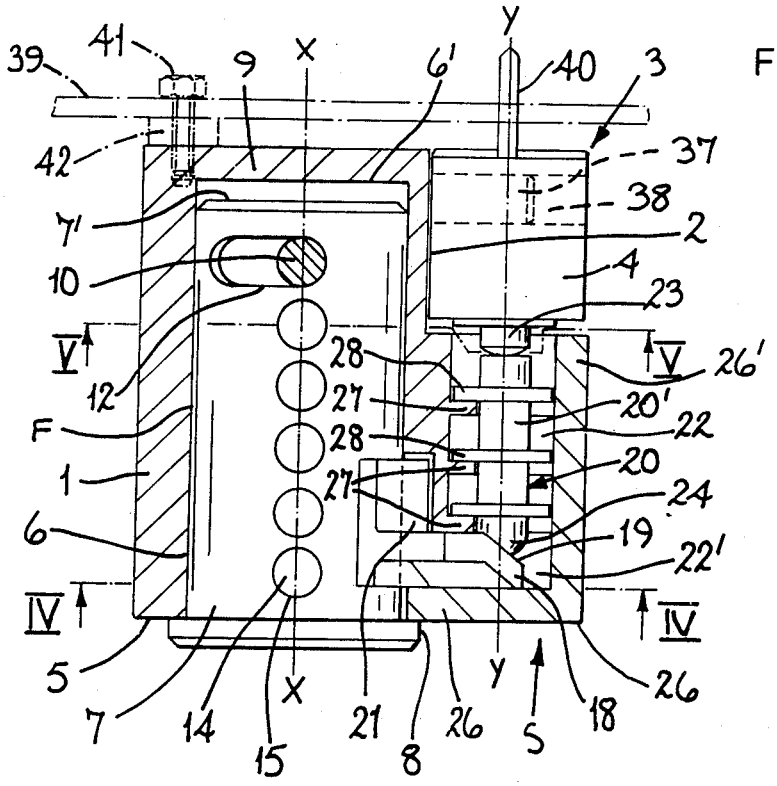
FIG. 2
FIG. 3
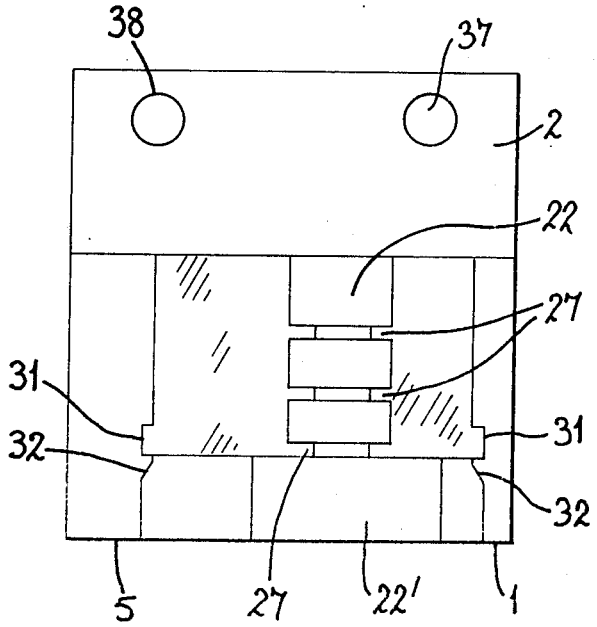

CYLINDER KEY SWITCH

BACKGROUND OF THE INVENTION

The present invention relates to a cylinder-operable key switch comprising a cylinder housing and a cylinder plug mounted rotatably therein, which acts upon an electrical switching device.

Key switches of this type are increasingly fitted into electronic equipment in order to determine whether an individual is entitled to operate the equipment or to maintain control over the equipment. Because of the high electrostatic potential of a person relative to earth voltage flash-over from the cylinder lock to the fixed contacts of the switching device could occur during insertion of the key. The consequence is then, in general, a malfunctioning of the electronic equipment, since the fixed contacts, which are in general connected to integrated circuits, cannot take such high loads. Attempts have been made, in such a design, to provide the cylinder housing with an insulating plastic sheathing, and to locate the switch side in a cup-shaped control armature opened up towards the key side, which is itself covered by a cup-shaped housing cap which is also made of insulating material. The axially-orientated design which results, however has a relatively great construction depth as can be seen from DE. No. 83 15 464.

SUMMARY OF THE INVENTION

An object of the invention is therefore to provide a cylinder-operable key switch of the type referred to above of simple construction and small constructional depth, which has a high insulation against flash-over voltage.

The invention provides a cylinder-operable key switch comprising a cylinder housing and a cylinder core mounted rotatably therein, which acts upon an electrical switching device, characterised in that the switching device is located at one side of and adjacent to the cylinder core, which operates the switching device by rotation of a control member.

A key switch according to the invention is distinguished by small structural depth and high reliability rating. Most of the devices which are to be provided with a key switch have relatively thin walls, and with the switch according to the invention there is no substantial interior overlap. Thus more work space is available and/or the electronic components can be seen or inspected more easily. This is not only of advantage during assembly but also provides improved accessibility during subsequent maintenance.

The key switch according to the invention is simple and effective. The switch is designed so that the switching device is located at one side adjacent to the cylinder core, which operates the switching device by rotation of a control member. The control member which is not axially aligned, but is positioned to one side of the cylinder, is not only spatially located in a preferred position, but this lateral position can be utilized optimally for the insulation of the housing with respect to flash-over voltage. Since for a laterally located control element or control member, no great depth is required, the area lying beyond the control element is almost entirely available for the switching device.

The control member is preferably designed as a finger projecting radially from the cylinder core, which is provided with a run-up bevel for a tripping pin of the switching device, which ascends in the axial direction and extends in the radial direction. Such a run-up bevel provides reduced abrasion in the transfer of the operating forces to the tripping pin resulting in an improvement in the transmission. In addition, the tripping pin forms a spacing means, which increases the path length to the switching device. To arrange the tripping pin most effectively, the latter is mounted so that it is displaceable in the axial direction inside a housing pit running parallel to the cylinder housing chamber. This parallel alignment, with the adjacent tripping pin, leads to a compact construction. Furthermore, it is advantageous for constructional reasons that at one end the tripping pin rests against a tripping plunger of the switching device and at the other end operates in conjunction with the run-up bevel by means of its dome-shaped top end. The spherical shape of the top end optimizes the desired low abrasion and ease of operation in switching.

It is further preferred that the housing pit is designed to be open on one longitudinal side of the cylinder housing. Through this side, means for transferring the tripping movement to the switching device, that is the tripping pin, is inserted. The housing pit is of rectangular, preferably square, cross section. If the tripping pin is of corresponding square cross section this results in an enclosed locating contact at three points of the tripping pin, each being staggered by 90 degrees. This also makes the displacement easier. The further securing in position and guiding of the tripping pin and the closure of the housing pit housing the pin is by means of a cover secured to the cylinder housing.

It is further preferred that at least one transverse dividing wall which is of U-shape in plan form is provided in the housing pit, so that the U-shaped compartment is open towards the open longitudinal side of the housing pit and the U-flanks accommodate the tripping pin of conforming cross section between them. This provides advantageous conditions for the insulation effect where flash-over voltage is produced. It is further preferred that the width of the U-flanks and of the U-web are equal and that the depth of the U-shaped compartment is approximately equal to the diameter of the tripping pin plus the width of the U-flank. The tripping pin is further provided with at least one circular collar which engages in the housing pit, which collar, together with the transverse dividing wall, forms a labyrinth. By increasing the number of collars and dividing walls the gap length between the cylinder core which is normally metallic and the switching device is increased. Accordingly, several axially equidistant transverse dividing walls are arranged within the housing pit, to each of which walls a corresponding collar of the tripping pin is assigned, so that a richly ribbed tripping pin with a correspondingly designed housing channel is provided.

The switching device is suitably attached to the cylinder housing by force-fitting dowel pins. The dowel pins may be part of the housing of the switching device, or of the lock housing or one or more may form part of the switch housing and one or more form part of the cylinder housing and thus be oppositely oriented. The cover is fastened in a simple way to the cylinder housing by means of a click-stop connection. To allow for lateral and also frontal access to the lock housing, the cover which merely covers the tripping pin is designed to be angular in cross section. The click-stop means preferably is formed by detents in one portion of the cover which engage cutouts formed in the housing. Steps are formed in another portion of the cover and are configured to mate with stop shoulders formed in the front wall of the cylinder housing.

BRIEF DESCRIPTION OF THE DRAWINGS

The invention will now be described with reference to the accompanying drawings, in which

FIG. 2 shows the key switch in horizontal sectional view, showing the adjoining location of the cylinder plug and the control member;

FIG. 3 shows a side view, as seen from the right hand side with cover removed and cylinder housing with core removed and switching device dismantled.

DETAILED DESCRIPTION OF THE DRAWINGS

The cylinder-operable key switch 5 has a cylinder housing 1. This is made of an insulating material, for example a plastics material. It is designed to be cubical, except for a corner cut-out 2.

Figure 1:
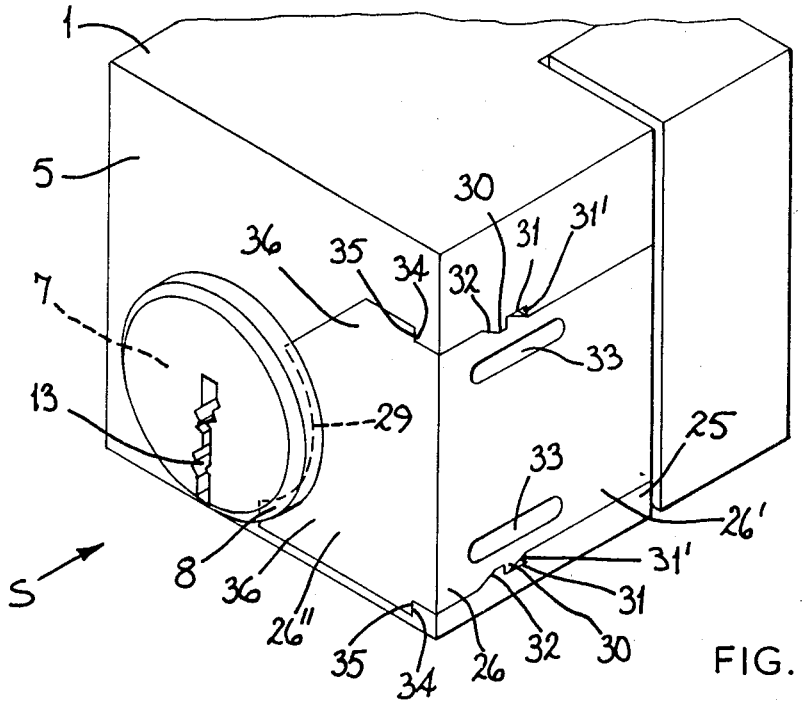
FIG. 1 shows an embodiment of the cylinder-operable key switch according to the invention in perspective view.

The corner cut-out 2 houses an electrical switching device 3. Its rectangularly-shaped housing 4 fills the cut-out 2, so that the cubical shape is completed in this area, as can be seen from FIGS. 1 and 2.

A longitudinal bore 6 starts at the front end 5 of the cylinder housing 1, and is terminated as a blind hole. This bore 6 is positioned in the lower region of the LH left hand corner (FIG. 1) and houses a cylinder core 7. The core 7 rotatably mounted therein terminates at its front end in an annular collar 8 which extends over the edge of the longitudinal bore 6. The maximum available depth is used to form cylinder core 7 so that only a relatively thin-walled backwall section 9 remains. The end 7' of the cylinder core 7 extends to within a short distance of the base 6' of the longitudinal bore 6 which forms the cylinder housing chamber.

Figure 5:
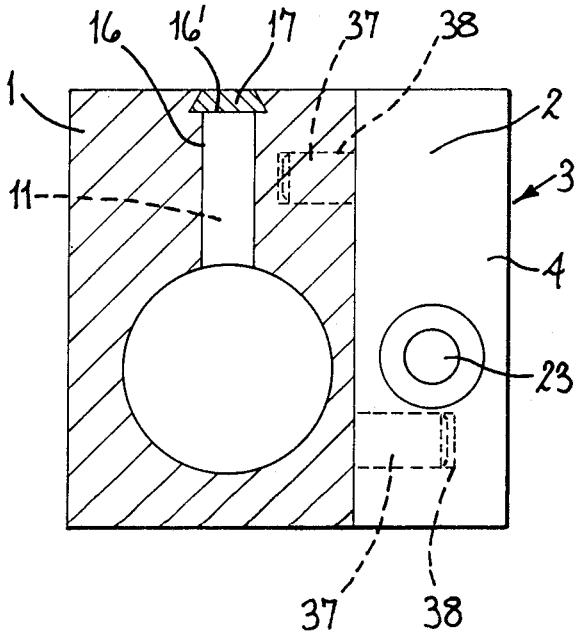
FIG. 5 is a sectional view according to the line V—V in FIG. 2.

A retaining pin 10 is provided for axially retaining cylinder core 7. The pin 10 extends radially to the rotational or longitudinal center axis x—x of the cylinder core 7. A location bore 11 for the retaining pin 10 is provided, as can be seen from FIG. 5. The opposite end of the retaining pin 10 engages in a transverse slot 12 on the circumference of the cylinder core 7. The transverse slot 12 is of a width which is equal to the diameter of the opposite end of the retaining pin 10. The length of the slot 12 defines the extent of the angular rotation of the cylinder core 7.

The cylinder core 7 is further provided with a keyway 13, into which a key, which is not shown, can be inserted. The key is in general a flat key, which is profiled on its broadsides. The keyway 13 has an appropriate counter-profiling, as can be seen from FIG. 1. On the narrow side remote from the back of the key, such a key is provided with locking notches. These arrange core pins 14, against which housing pins are located. The pins are adjusted by a suitable key so that the pin faces opposed to one another align with the joint F between longitudinal bore 6 and circumference of the cylinder core 7. The cylinder core 7 can then be turned by means of the key.

Figure 4:
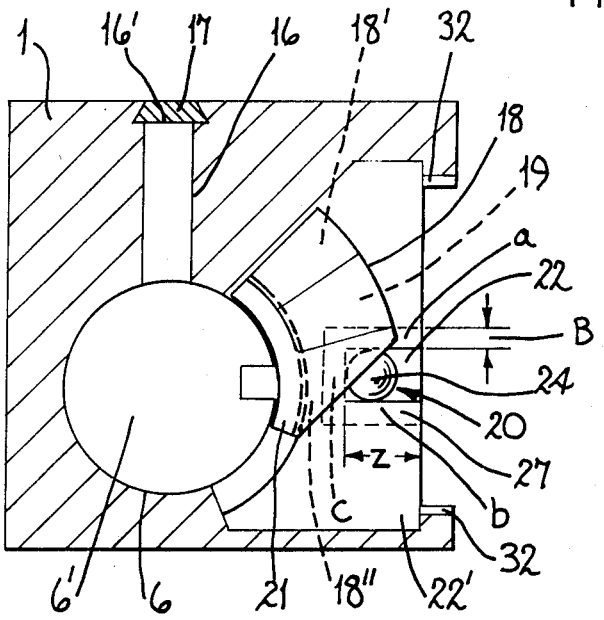
FIG. 4 shows a sectional view according to the line IV—IV in FIG. 2.

Bores 15 house the core pins 14 in a row. The bores 16 house the housing pins. The location of bore 11 lies in the row of the bores 16, being the last one of the line. The housing pins are biased by compression springs housed inside the bores 16 of the cylinder housing 1, which springs butt against the bases 16' of the bores. Turning the cylinder core 7 back into the initial starting position as shown in FIG. 4, allows the key to be withdrawn again. The pins are no longer in the adjusted position and thus the cylinder core 7 is locked.

The electrical switching device 3 extends laterally adjacent to the cylinder core 7. It is operated by rotary movement of a control member of the cylinder core 7, which control member extends sufficiently into the laterally adjacent zone.

Figure 6:
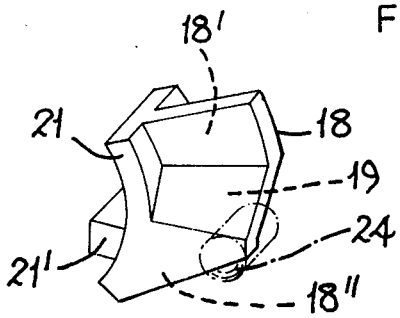
FIG. 6 is a perspective view of control member which can be mounted on to the cylinder core.

The control member is a finger 18 which projects radially from the cylinder core 7 to the right-hand side as can be seen in FIG. 6. The finger 18 is provided with a run-up bevel 19 which ascends in the axial direction and extends in the radial direction. The run-up bevel 19 is in the form of a uniformly ascending helical section and activates a tripping pin 20 which cooperates with the electrical switching device 3, by acting upon this device.

The finger 18 is located in the vicinity of the annular collar 8. Its mounting base 21 at the end of the cylinder core 7 is positioned within the adjoining first third of the length of the cylinder core 7. The finger 18 is an angular base body, the one arched side of which abuts the circumferential surface of the cylinder core 7 and engages positively in a lateral longitudinal slot of the cylinder core by means of a longitudinally extending rib 21'. The length of the run-up bevel 19 which is involved in driving uses a rotary angle of approximately 30 degrees, defined by the transverse slot 12. The run-up bevel may be terminated at either end by non-inclined end sections 18', 18''.

As can also be seen from FIG. 2, the tripping pin 20 is mounted to be displaceable in the axial direction inside a housing channel 22 running parallel to the cylinder housing chamber formed by the longitudinal bore 6. The longitudinal axis of the housing channel 22 which contains the tripping pin 20 is marked y—y. Its distance from the longitudinal centre axis x—x of the cylinder core 7 is approximately equal to the outside diameter of the cylinder core 7.

The tripping pin 20 rests at one end against a push-button-like tripping plunger 23 of the switching device 3 which is spring-loaded in the direction of its extended position as shown and is thus also biasing the tripping pin in the direction of the normal position. The cylindrical end of the pin 20 has a flat face, while the top end of the tripping plunger 23 is slightly arched and is axially symmetrical. At the other end the tripping pin 20 works together with the control or run-up bevel 19 of the finger 18 by means of its dome-shaped top end 24. This end is also designed to be cylindrical.

In order to insert the tripping pin 20, its housing channel 22 is open towards the longitudinal side 25 of the cylinder housing 1. The housing channel 22 is of rectangular cross section but can alternatively be rounded in the base where it is desired that the cross section of the shank should match the shape. For the shank 20', a square design is preferred between the two cylindrical ends of the tripping pin 20. The open longitudinal side 25 of the housing channel 22 is closed by a cover 26 after the insertion of the tripping pin 20.

Housing channel 22 includes at least one transverse dividing wall 27 which is U-shaped in plan form. The inner sides of the transverse dividing wall 27 are used to form the central contour of the housing channel 22. As can be seen from the preferred embodiment illustrated in the accompanying drawings, several axially equidistant transverse dividing walls 27 are provided within the housing channel 22. The U-compartment is open towards the longitudinal side 25 of the housing channel 22, so that the two U-flanks a, b running parallel to one another house between them the shank 20' of the tripping pin 20, which is provided with further support by the U-web c connecting the U-flanks a, b.

The widths of the U-flanks a, b and the U-web C are of preferably equal size and that the depth z of the U-shaped compartment is approximately equal in size to the diameter of the shank 20' of the tripping pin 20, plus a U-flank web width B. It is further provided that at least one circular collar 28 is located on the tripping pin 20, which collar is located in the housing channel 22, which locates against the side of the U-shaped transverse dividing walls 27 facing the switching device 3 and, together with the transverse dividing wall or walls 27, forms a kind of labyrinth because of the ribbing of the tripping pin 20 and housing channel 22. This labyrinth prevents flash-over to the device which may for example include integrated circuits, the flash-over being caused by the static potential of the operator inserting the key into the cylinder lock 7. The corner deflection zones between the collar 28 and the large number of transverse dividing walls 27 lengthen the air gap path to the switching device 3, thus increasing the path length for the flash-over voltage which results in the magnitude thereof being progressively reduced within the labyrinth. The long path can easily be seen from FIG. 2. For the same reason the cylinder housing, as already discussed, is moulded from non-conducting material. Similarly the tripping pin 20, and the cover 26 are also made of plastic material.

The collars 28 are of square plan form. The flange portion of the collar pointing in the direction of the longitudinal side 25 bears on the inner face of the cover 26. The collar thickness is equal to approximately one fifth of the axial distance between the transverse dividing walls 27, so that the transverse movement of pin 20 is not unduly limited. In place of the square ribbing system illustrated, a round system can be used.

The cover 26 is secured to the cylinder housing 1 by means of a click-stop connection. This cover 26 is an angularly shaped component. Because of the cubical design, the angle is a right angle. The leg 26' of the cover 26 covering the tripping pin 20 externally fits flush with the outer face of the longitudinal side 25, and so is flush mounted. The other leg 26'' facing the front end 5 also covering only the tripping pin 20 or finger is similarly integrated into the front end, so that it does not protrude from it.

For the click-stop connection, detents 30 are formed on both opposite end faces of the leg 26' of the cover 26 covering the long side of the housing channel 22, which engage appropriate cutouts 31 of the cylinder housing 1. In front of the cutouts 31 in the attachment direction a run-up bevel 32 is provided at each side. To provide a reversible click-stop connection, a material reduction 33 has been made in the rear region of the detents 30 relative to the leg. It is in the form of elongated slots or slot-like clearances which run parallel with the said end faces spaced therefrom by a distance, which leave a bridge-like zone bearing the detent 30.

The contour of the detent 30 differes from that of the cutout 31 in that a small free space 31' is left for the introduction of a lifting out tool.

In order to provide a secure position for the cover 26, so that the latter cannot slip off its transverse side, the two parallel end faces of the other leg 26'' are designed to form steps, which, matched in shape, engage behind appropriate stop shoulders 34 within the front side 5 of the cylinder housing. Such stop shoulders 34 are formed by cutting back the wider channel section 22' located in front of the housing channel 22, which also forms at the same time a chamber for the finger 18 within the front side 25 of the cylinder housing as can be seen from FIG. 1. The counter-stop area 35 forms a contour-matching extension zone 36 of the leg 26'' at the end of the front side.

The electrical switching device 3 can be attached and removed without having to open the cover 26. For attachment two dowel pins 37 lying one after another in the longitudinal direction of the housing 4 of the rectangularly-shaped switching device are provided. One dowel pin 37 is formed and located in the housing of the switching device 3 in bore 38. The other is formed on the housing 4 of the switching device 3 and locates in a corresponding bore 38 in the cylinder housing 1. This arrangement simplifies assembly, and is rigid due to force fitting of the dowel pins.

The cylinder-operable key switch 5 illustrated is provided with a side plate 39. For its fixing, contact pins 40 of the electrical switching device 3 which are either solderable onto or insertable into the back of the side plate 39 are provided and additionally securing means in the form of screws 41, which, when a spacer 42 is placed therebetween, engage into the suitably tapped hole in the back of the lock housing 1, are also provided.

I claim:

1. A cylinder-operable key switch comprising:

a cylinder housing having a first axially extending bore;

a cylinder core rotatably mounted within said first axially extending bore of said cylinder housing;

said housing having a second bore extending generally parallel to and laterally offset from said first bore;

an electrical switching element disposed in substantially axial alignment with said second bore;

an axially movable control pin mounted in said second bore and having an operative position contacting said switching element and an inoperative position;

a control member connected to said cylinder core for rotation therewith and extending laterally into said second bore for selectively axially driving said control pin to its operative position; and wherein said second bore forms a housing channel which is open on one longitudinal side of said cylinder housing.

2. Cylinder-operable key switch according to claim 1 wherein said switching device is attached to said cylinder housing by force fitting dowel pins.

3. Cylinder-operable key switch according to claim 1 wherein said control member is designed as a finger projecting radially from said cylinder core which is provided with a run-up bevel for said control pin, said finger having a pin engaging surface which ascends in the axial direction and extends in the radial direction.

4. Cylinder-operable key switch according to claim 3 wherein said control pin includes a dome-shaped first end and said switching element includes an axially extending control plunger, the other end of said control pin bearing against one end of said control plunger with said dome-shaped end of said control pin bearing against said run-up bevel of said control member for moving the control pin axially to likewise move said control plunger axially.

5. Cylinder-operable key switch according to claim 1 wherein said housing channel is of rectangular cross section.

6. Cylinder-operable key switch according to claim 5 wherein said housing channel is of square cross section.

7. Cylinder-operable key switch according to claim 1 wherein said housing channel includes at least one transverse dividing wall which is U-shaped in plan form to form a U-shaped compartment opening towards said open longitudinal side of the housing channel and the dividing wall comprises a pair of spaced U-flanks which house said control pin therebetween.

8. Cylinder-operable key switch according to claim 7 wherein the width of said U-flanks is equal to the width of the U-web and that the depth of the U-shaped compartment is approximately equal to the diameter of said control pin plus a U-flank width.

9. Cylinder-operable key switch according to claim 7 wherein said control pin has at least one circular collar which engages the wall of the housing channel, said collar, together with said transverse dividing wall, forming a labyrinth.

10. Cylinder-operable key switch according to claim 9 wherein said housing channel includes a plurality of axially equidistantly spaced transverse dividing walls and said control pin includes a circular collar for each dividing wall.

11. Cylinder-operable key switch according to claim 1 wherein said cylinder housing has a cover secured thereto for closing the open longitudinal side of the housing channel.

12. Cylinder-operable key switch according to claim 11 wherein said cover is fastened to said cylinder housing by means of a click-stop connection.

13. Cylinder-operable key switch according to claim 11 wherein said cover includes a first leg having detents formed on opposite end faces thereof and said cylinder housing includes cut outs for engagement by said detents, said cover including a second leg having end faces forming steps, and said cylinder housing includes stop shoulders which are matched in shape to said steps and are engaged thereby.

14. Cylinder-operable key switch according to claim 11 wherein said cover covers only said control pin and is angular in cross section.

15. Cylinder-operable key switch according to claim 14, wherein said cover is right-angled in cross section.

* * * * *